US005769706A

United States Patent [19]

Cheek

[11] Patent Number: 5,769,706

[45] Date of Patent: Jun. 23, 1998

[54] SLOT VENTILATOR

[75] Inventor: Ron Cheek, Witham, England

[73] Assignee: Titon Hardware Limited, England

[21] Appl. No.: 613,967

[22] Filed: Mar. 8, 1996

[30] Foreign Application Priority Data

Mar. 10, 1995 [GB] United Kingdom ..... 950487

[51] Int. Cl.[6] ..... F24F 7/00

[52] U.S. Cl. ..... 454/195; 454/211; 454/213

[58] Field of Search ..... 454/195, 211, 454/213

[56] References Cited

U.S. PATENT DOCUMENTS

| | | | |
|---|---|---|---|
| 287,791 | 11/1883 | Badger | 454/213 |
| 864,792 | 9/1907 | Meek | 454/213 |
| 1,119,288 | 12/1914 | Kurz | 454/213 |
| 2,182,576 | 12/1939 | Bancroft | 454/211 |
| 2,221,497 | 11/1940 | Thomas | 454/213 |
| 3,908,528 | 9/1975 | Bertin et al. . | |
| 4,592,271 | 6/1986 | Young . | |
| 4,677,904 | 7/1987 | Natsumeda et al. . | |

FOREIGN PATENT DOCUMENTS

| | | | |
|---|---|---|---|
| 0236683 | 9/1987 | European Pat. Off. . | |
| 1 934 996 | 1/1971 | Germany | 454/213 |
| 2 127 144 | 4/1984 | United Kingdom | 454/213 |
| 2199860 | 1/1988 | United Kingdom . | |

*Primary Examiner*—Harold Joyce
*Attorney, Agent, or Firm*—Price,Heneveld, Cooper, DeWitt & Litton

[57] ABSTRACT

A slot ventilator 14 is located adjacent (entrance apertures 30, 38 of a window frame 10 and sash spar 12. The entrance apertures lead in substantially perpendicular directions into ventilation slots 22, 32 through the frame spar and sash spar. An abutment 56 is provided for location between the two spars. A spacer 50 and gasket 54 are located adjacent the entrance to the sash spar, and a rotatable closure member 62 controls the effective outlet area of the ventilator.

17 Claims, 1 Drawing Sheet

SLOT VENTILATOR

Figure 1:
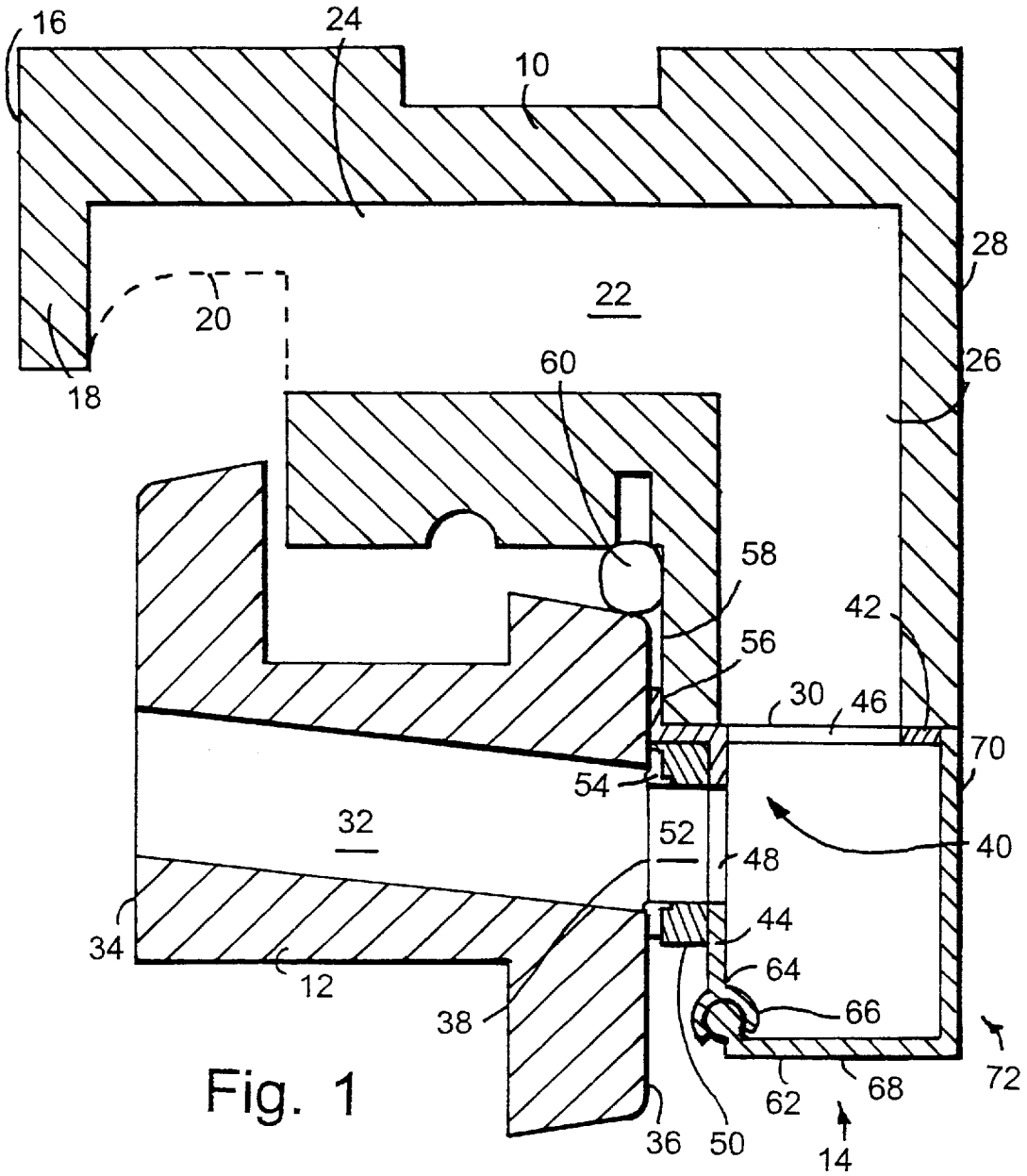

The present invention relates to a slot ventilator, for example for use in a room with a sealed window or a window with double or single glazing or a door, wherein it is desirable to provide ventilation without having to open the window or door. The invention also relates to a window or door assembly. GB1417751 discloses a slot ventilator comprising a slotted backing member, an elongate facing strip, and a linkage mechanism connecting the backing member and facing strip with one another, the linkage mechanism being arranged to permit generally translational forward and backing movement of the facing strip between a closed position in which the slot is closed and an open position in which the facing strip is spaced in front of the backing member.

Such a ventilator may be conveniently mounted with the slotted backing member in a slot which passes through a door or window member to provide ventilation between the two sides of the member. It is known to mount such a ventilator in the sash or window frame of a window.

In some circumstances it is desirable to provide more ventilation to a room than a ventilator mounted to one spar of a window sa.,h or frame can provide. This problem is particularly significant when it is desirable to provide window ventilation in a room which only has small windows. One attempt which has been made to overcome this problem is to provide two or more ventilators to ventilate two or more respective slots in two or more spars of a window assembly. However, when it is desirable to control the level of ventilation to the room, it is necessary to adjust two or more ventilators. It is also relatively expensive to provide and fit several ventilators.

The present invention aims to alleviate the problems of the prior art.

According to a first aspect of the present invention there is provided a slot ventilator comprising a housing, the housing having a ventilation inlet portion and a ventilation outlet portion, the housing being adapted for location on one of first and second building elements with the inlet portion located adjacent first and second ventilation slots through the first and second elements.

The housing may be adapted for location adjacent three or more ventilation slots through two, three or more building elements.

The ventilator may be mounted in the vicinity of a door or window assembly. In the latter case, the first and second building elements may comprise first and second spars of the assembly, such as a sash member and a window frame member which are adjacent one another.

The ventilator has the substantial advantage that, with a relatively small window, it is possible to mount only one ventilator to the assembly which is capable of providing a relatively large amount of ventilation.

Preferably, the ventilation inlet portion is adapted to sealingly co-operate with entrances to the first and second ventilation slots.

Preferably, the inlet portion comprises first and second separate inlet apertures, preferably in the form of elongate slots, formed through an inlet wall of the housing. The inlet portion may be provided with three or more inlet apertures which may be locatable adjacent two, three or more ventilation slots in two, three or more building elements.

In a preferred embodiment, the inlet wall of the housing includes a first slotted portion which is adapted to be aligned with a slot in the first building element. The first slotted portion is preferably fixedly mountable to the first building element. In this case, the first building element may comprise a spar of a window frame.

The inlet wall of the housing preferably includes a second slotted portion which is adapted to be aligned with a slot through the second building element. In this case, the housing may be fixedly mounted to a window frame with the first slotted portion aligned with a slot through the window frame, and the second slotted portion aligned with a slot through a window sash. When the window sash is movable relative to the window frame for opening and closing of the window, the ventilator may thus remain fixed in position on the window frame while the window sash is moved. Alternatively, the ventilator may be fixedly mounted to the window sash and may move with the sash as it is moved for opening and closing the window. When the window sash is not movable relative to the window frame, the ventilator may be fixedly mounted to either of the window sash and frame, or both.

Preferably, the slotted portions of the inlet wall are each generally planar. The slotted portions of the inlet wall are preferably orientated aslant to one another. In a most preferred embodiment the slotted portions of the inlet wall are orientated substantial perpendicular to one another.

Preferably, the slotted portions of the inlet wall are integral with one another. The inlet wall may be formed by extrusion to result in the slotted portions being integral with one another.

The ventilator may include a slotted spacer located adjacent one of the inlets of the inlet portion for spacing the housing inlet wall from one of the building elements. The thickness of the spacer may be chosen, dependent upon the particular configuration of the entrances to the slots in the first and second building elements with respect to one another.

Preferably, the housing includes an abutment adapted to be located between the first and second building elements.

Preferably, the ventilator includes a sealing gasket which is adapted to seal between the housing and the entrance to one of the first and second ventilation slots. The gasket may be of deformable resilient material. The gasket may be located on a spacer, when such is provided. Preferably, the gasket comprises a slotted element which is adapted to seal around the entrance to one of the slots in the building elements.

Preferably, the inlet portion of the ventilator includes inlet apertures or slots which provide a combined ventilation area of 8,000 millimeters squared or more.

When the housing includes two slotted portions in an inlet wall thereof, each slotted portion may have a slotted area of 4,000 square millimeters or more.

Preferably, the ventilator outlet portion includes a movable closure member which is selectable between positions to control the effective outlet area of an outlet opening of the ventilator. The closure member may be hinged to the inlet portion of the housing at a hinge.

The closure member may be configured to control the amount of ventilation through the ventilator in various other ways. For example, the outlet of the ventilator may incorporate a parallel motion linkage as described in PCT application No. PCT/GB94/02130 or GB1417751, or may incorporate a hit and miss arrangement including two members with alignable apertures therein as described in U.S. Pat. No. 1,116,625.

When the first and second building elements are movable relative to one another, they may be pivotal relative to one another. One example of such an arrangement would be where one of the building elements comprises a spar of a window frame and the other a spar of a window sash, and the window sash is pivotable relative to the frame to open and close the window.

According to a further aspect of the invention, there is provided a window or door assembly including a frame member locatable on a building structure and a second member located adjacent a window or door (or consisting of a door), each member having a ventilation slot therethroug, each slot having an (entrance on each side of its respective member, the entrances on one side of the assembly being located on surfaces of the two members which are transverse to one another. Preferably, the transverse surfaces are substantially perpendicular to one another.

In a preferred embodiment, the assembly comprises a window assembly.

Preferably, the assembly includes a ventilator according to the first aspect of the invention which is located adjacent the transverse surfaces to control ventilation through the slots.

According to a third aspect of the invention, there is provided a window or door assembly including two adjacent members with ventilation slots formed therethrough, and a cover which covers an entrance to each one of the slots. Preferably, the assembly comprises a window assembly and the members comprise a window frame and a window sash. Preferably, the cover comprises a ventilator according to the first aspect of the invention.

The present invention may be carried out in various ways and a preferred embodiment of a window assembly and ventilator in accordance with the invention will now be described, by way of example, with reference to the accompanying drawings, in which:

FIG. 1 is a schematic vertical section through part of a preferred embodiment of a window assembly in accordance with the invention.

With reference to FIG. 1, a window assembly includes a window frame with a top window frame spar 10, a top window sash spar 12 and a ventilator 14.

The frame spar 10, which is preferably of wood, is located adjacent the top of a window aperture in a building (not shown).

The frame spar 10 at an outer side thereof 16 includes a drip ledge 18 for preventing the ingression of rain or other precipitation, and a mesh 20 for preventing the ingression of insects and other undesirable matter.

The frame spar 10 incorporates a ventilation slot 22 which extends along the length thereof. The slot 22 in the frame incorporates a generally horizontal portion 24 which leads into a generally vertical portion 26 at the inner side 28 of the frame spar 10.

The vertical portion 26 of the frame ventilation slot 22 terminates at a generally horizontal slotted entrance aperture 30.

The sash spar 12 is shown located adjacent to the frame spar 10. The sash spar 12 is pivotable relative to the frame spar 10, in a known way to open and close the window. The sash spar 12 incorporates a generally horizontal ventilation slot 32 which leads from an outer side 34 of the sash spar to an inner side 36 thereof.

At the inner side 36 of the sash spar 12, the ventilation slot 32 terminates at a generally vertical slotted entrance aperture 38. The ventilation slot 32 extends along the length of the sash spar 12.

The ventilator 14 is located adjacent the entrance apertures, 30, 38 of the frame 10 and sash spar 12.

The ventilator includes an inlet wall 40, the inlet wall comprising an upper wall 42 and a side wall 44, the upper 42 and side 44 walls being substantially perpendicular to one another.

The ventilator 14 is secured to the frame spar 10 by screw fastenings (not shown) which pass through apertures (not shown) in the upper wall 42, into the frame spar 10.

The upper wall 42 includes an elongate slot 46 formed therethrough and the side wall 44 includes a similar elongate slot 48 formed therethrough.

The window sash spar 12 is spaced from the slot 48 in the side wall 44 by a spacer 50 which includes an elongate slot 52 corresponding to the elongate slot 48. The airpath through the ventilation slot 32 through to the elongate slot 48 is sealed by a deformable resilient gasket 54 which is located between the entrance aperture 38 and the spacer 50. When the sash spar 12 is brought into position to close the window, the gasket 54 deforms in response to the compressive force applied to it by the spar 12.

The upper wall 42 of the ventilator 14 terminates at the outer side of the ventilator 14 at a generally vertical abutment 56 which is located adjacent an outer face 58 of the portion of the frame spar 10 which forms the generally vertical portion 26 of the ventilation slot 22. Thus, when the window sash spar 12 closes against the window frame spar 10 and compresses the gasket 54, the abutment 56 ensures that the ventilator is not easily displaced from its position on the window frame 10. This is particularly advantageous when it is anticipated that the window will be slammed.

When the window sash 12 is located in the closed position shown in FIG. 1, a gasket 60 between and touching the frame spar 10 and sash spar 12 ensures that no ventilation may pass between the frame 10 and sash 12 spars. Any ventilation across the window must therefore pass through the ventilation slots 22 and 32, into the ventilator 14.

The ventilator includes a closure member 62 which is pivotally mounted to a lower edge 64 of the side wall 44 by a hinge 66. The closure member includes a Lower wall 68 opposite the upper wall 46 of the inlet wall 40, and a side wall 70 opposite the side wall 44 of the inlet wall. The upper and lower walls 42, 68 and side walls 44, 70 form a housing 72 of the ventilator.

FIG. 1 shows the closure member 62 in a closed position thereof in which no ventilation may pass through the ventilator 14. The closure member 62 may be rotated about the hinge 66 to an open position thereof wherein ventilation may pass through the slots 22, 32 from one side of the window to the other.

The elongate slot 46 has an area of 5,000 sq millimeters and the elongate slot 48 has an area of 3,000 sq millimeters, giving the inlet wall 40 a combined ventilation area of 8,000 sq millimeters.

The window sash spar 12 is preferably of wood, like the frame spar 10, but in other embodiments these could be of other materials, such as plastics or a metal alloy.

The ventilator may be provided, in alternative embodiments, with a hit and miss or parallel motion closure member.

The window sash may be slidable relative to the window frame for opening and closing the window, or pivotable, or openable in other way, or may be fixed closed or open.

I claim:

1. A window or door assembly comprising a first building element defining a first ventilation slot through the first element, a second building element defining a second ventilation slot through the second element, and a slot ventilator comprising a housing, the housing having a ventilation inlet portion, the housing being located on one of the first and second building elements with the inlet portion located adjacent the first and second ventilation slots through the first and second elements, the inlet portion comprising first and second separate inlets formed as slotted portions of an inlet wall of the housing, the inlet wall of the housing including a first slotted portion which is aligned with a slot in the first building element, the inlet wall of the housing including a second slotted portion which is aligned with a slot through the second building element, the slotted portions of the inlet wall being each generally planar, and the slotted portions of the inlet wall being orientated a slant to one another.

2. A window or door assembly as claimed in claim 1 in which the slotted portions of the inlet wall are integral with one another.

3. A window or door assembly as claimed in claim 1 which includes a slotted spacer located adjacent one of the inlets of the inlet portion for spacing the housing inlet wall from one of the building elements.

4. A window or door assembly as claimed in claim 1 in which the housing includes an abutment located between the first and second building elements.

5. A window or door assembly as claimed in claim 1 which includes a sealing gasket which is adapted to seal between the housing and the entrance to one of the first and second ventilation slots.

6. A window or door assembly as claimed in claim 1 in which the inlet portion of the ventilator includes said slotted portions which provide a combined ventilation area of 8,000 millimeters squared or more.

7. A window or door assembly as claimed in claim 1 in which the ventilator includes a movable closure member which is selectable between positions to control the effective inlet portion of the slotted portions of the ventilator.

8. A slot ventilator comprising a housing, the housing having a ventilation inlet portion, the housing being adapted for location on one of first and second building elements, first and second ventilation slots being provided through the first and second building elements, the inlet portion located adjacent the first and second ventilation slots; the inlet portion comprising first and second separate inlets formed as slotted portions of an inlet wall of the housing; the inlet wall of the housing including a first slotted portion which is adapted to be aligned with a slot in the first building element, and a second slotted portion which is adapted to be aligned with a slot through the second building element; the slotted portions of the inlet wall being generally planar and orientated aslant to one another.

9. A slot ventilator as claimed in claim 8 in which the slotted portions of the inlet wall are integral with one another.

10. A slot ventilator as claimed in claim 8 which includes a slotted spacer located adjacent one of the inlets of the inlet portion for spacing the housing inlet wall from one of the building elements.

11. A slot ventilator as claimed in claim 8 in which the housing includes an abutment located between the first and second building elements.

12. A slot ventilator as claimed in claim 8 which includes a sealing gasket which is adapted to seal between the housing and the entrance to one of the first and second ventilation slots.

13. A slot ventilator as claimed in claim 8 in which the inlet portion of the ventilator includes said slotted portions which provide a combined ventilation area of 8,000 millimeters squared or more.

14. A slot ventilator as claimed in claim 8 in which the ventilator includes a movable closure member which is selectable between positions to control the effective inlet portion of an outlet opening of the ventilator.

15. A slot ventilator as claimed in claim 8 in which the slotted portions of the inlet wall are substantially perpendicular to one another.

16. A window assembly comprising:

a window frame having a window frame spar defining a first ventilation slot; and a window sash spar defining a second ventilation slot; each of the slots having a ventilation entrance; the window sash spar in a closed configuration of the window assembly being sealed to the frame spar by a gasket so that no ventilation may pass between the frame spar and the sash spar; and a slot ventilator comprising a housing having an inlet portion, the inlet portion having first and second separate inlets formed as slotted portions of an inlet wall of the housing, the housing being located on one of the sash frame spar and the window frame spar with one of the inlets of the housing being aligned with and co-operating with the ventilation entrance of the window frame spar and the other of the inlets of the housing being aligned with and co-operating with the ventilation entrance of the window sash spar.

17. A window or door assembly comprising a first building element defining a first ventilation slot, a second building element defining a second ventilation slot, and a slot ventilator comprising a housing, the housing having a ventilation inlet portion, the housing being located on one of the first and second building elements with the inlet portion located adjacent the first and second ventilation slots through the first and second elements, the inlet portion comprising first and second separate inlets formed as slotted portions of an inlet wall of the housing, the inlet wall of the housing including a first slotted portion which is aligned with a slot in the first building element, the inlet wall of the housing including a second slotted portion which is aligned with a slot through the second building element, each of the slotted portions of the inlet wall being generally planar and substantially perpendicular to one another.

* * * * *

UNITED STATES PATENT AND TRADEMARK OFFICE

CERTIFICATE OF CORRECTION

PATENT NO. : 5,769,706
DATED : June 23, 1998
INVENTOR(S) : Ron Cheek

It is certified that error appears in the above-identified patent and that said Letters Patent is hereby corrected as shown below:

On the title page, item [54]:

Inventor:

"Ron Cheek, Witham, England" should be --Ron Cheek, Witham, Essex, England--.

Assignee:

"Titon HardwareLimited, England" should be --Titon Hardware Limited, Stanway, Colchester, Essex CO3 5JY--.

Abstract, line 1;

"(entrance" should be --entrance--.

Column 1, line 24;

"sa.,h" should be --sash--.

Column 3, line 9;

"therethroug" should be --therethrough--.

Column 3, line 8;

"(entrance" should be --entrance--.

UNITED STATES PATENT AND TRADEMARK OFFICE

CERTIFICATE OF CORRECTION

PATENT NO. : 5,769,706
DATED : June 23, 1998
INVENTOR(S) : Ron Cheek

It is certified that error appears in the above-identified patent and that said Letters Patent is hereby corrected as shown below:

*Column 5, Claim 1, line 8;

"a slant" should be --aslant--

Column 6, Claim 14, line 14;

Delete "an outlet opening" and insert --the slotted portions--.

Signed and Sealed this

Twenty-third Day of March, 1999

*Attest:*

Q. TODD DICKINSON

*Attesting Officer*

*Acting Commissioner of Patents and Trademarks*